US006733419B2

(12) United States Patent
Liu et al.

(10) Patent No.: US 6,733,419 B2
(45) Date of Patent: May 11, 2004

(54) EXERCISE PATTERN CONTROL METHOD AND SYSTEM FOR CONNECTING ROD LOCUS-TYPE EXERCISE APPARATUS

(75) Inventors: Pao-Pao Liu, Kao-Shiung Hsien (TW); Hung-Sheng Wu, Kao-Shiung (TW); Chun-Ho Chen, Tai-Ping (TW); Mu-Jo Wu, Taichung Hsein (TW)

(73) Assignee: Taiwan Bicycle Industry R&D Center, Taichung (TW)

( * ) Notice: Subject to any disclaimer, the term of this patent is extended or adjusted under 35 U.S.C. 154(b) by 0 days.

(21) Appl. No.: 10/270,210

(22) Filed: Oct. 15, 2002

(65) Prior Publication Data

US 2004/0072651 A1 Apr. 15, 2004

(30) Foreign Application Priority Data

Dec. 31, 2001 (JP) ..... 90133538 U

(51) Int. Cl.[7] ..... A63B 69/16
(52) U.S. Cl. ..... 482/8; 482/51; 482/52
(58) Field of Search ..... 482/51–53, 57, 482/70, 79, 80, 62, 148, 1–9, 900

(56) References Cited

U.S. PATENT DOCUMENTS 6,500,096 B1 * 12/2002 Farney ..... 482/52
6,612,969 B2 * 9/2003 Eschenbach ..... 482/51
6,629,909 B1 * 10/2003 Stearns et al. ..... 482/52

* cited by examiner

*Primary Examiner*—Glenn E. Richman
(74) *Attorney, Agent, or Firm*—Charles E. Baxley

(57) ABSTRACT

An exercise pattern control method and system for connecting rod locus-type exercise apparatus that establishes an exercise physiology database, an exercise resistance pattern database, and an exercise locus database. Based on the exercise resistance pattern settings and locus exercise pattern settings along with the sensed user heart beat, leg angle speed, and connecting rod length, and other relevant figures so archived, a controller then calculates and processes all the database data and figures to accordingly control the length extension of the connecting rod relative to the current physiological condition of the user. As such, the present invention enables the exercise apparatus to have an operational means of locus configuration to effectively match the physiological condition of the user, thereby achieving utilization convenience, safety, and enhanced exercise efficacy.

4 Claims, 6 Drawing Sheets

EXERCISE PATTERN CONTROL METHOD AND SYSTEM FOR CONNECTING ROD LOCUS-TYPE EXERCISE APPARATUS

BACKGROUND OF THE INVENTION

1) Field of the Invention

The invention herein relates to an exercise pattern control method and system for connecting rod locus-type exercise apparatus, specifically an integrated approach that establishes an exercise physiology database, an exercise resistance pattern database, and an exercise locus database. Referencing the relevant figures of sensed heart beat rate, leg angle speed, connecting rod length, a controller then calculates and processes all the database data and figures to accordingly control the length extension of the connecting rod relative to the current physiological condition of the user. As such, the present invention enables the exercise apparatus to have an operational means of locus configuration to effectively match the physiological condition of the user, thereby achieving utilization convenience, safety, and enhanced exercise efficacy.

2) Description of the Prior Art

Conventional connecting rod locus-type exercise apparatus are currently available in a wide variety of arrangements such as jogging machines and elliptical exercise machines. The invention herein cite an example of such elliptical machines for purposes of explanation. A conventional elliptical machine, as indicated in FIG. 1, typically consists of handle rods 11 hinged to a base 10, a pull bar 12 at the top end of the said handle rods 11, a connecting rod 13 conjoined to bottom end of each handle rods 11, pedal board 14 slide rods 15 pivotably conjoined to the connecting rods 13, a transmission mechanism 20 on the said base 10, a shaft rotated by the said transmission mechanism 20, a crank rod 21 positioned on the end section of the said shaft, the said crank rod 21 also pivotably conjoined to one extremity of the said slide rod 15, with the other extremity of the said slide rods 15 capable of movement along a slotway 16 on the said base 10. However, the said conventional elliptical machine is not equipped with an advantageous structure that matches the physical build of the user or provides for jogging speed stride adjustments. The maximum distance from beginning to end of the two pedal boards 14 is fixed and given that the stride of individuals having long or short legs differs, when two such persons utilize the same fixed stride elliptical machine, one will feel that it does not match and is inappropriate. Furthermore, whether long- or short-legged, when the jogging speed is fast or slow, the human body normally takes longer steps at higher speeds and shorter steps at lower speeds. As such, conventional fixed stride elliptical machine structures are incapable of adaptively matching user requirements with exercise performance. Additionally, there are extension structure elliptical machines such as the one invented by Kuo Hai-pin filed under Taiwan Patent No. 441,368. However, such conventional elliptical machines only have a handle rod extension structure and the maximum distance between the pedal boards remains invariable. Furthermore, the said elliptical machine also lacks a crank rod length sensing structure and thus is incapable of supporting program designs that automatically control exercise locus patterning. As the said elliptical machine is obviously incapable of matching the different physical constitutions, strides, and jogging speeds of users with exercise patterns that automatically vary the maximum interval of the two pedal boards, it cannot meet ergonomic requirements or effectively attain optimal exercise efficacy. Furthermore, there is a conventional structure of a similar arrangement, namely an extension structure elliptical machine invented by Kuo Chun-chang and publicly disclosed as Patent No. 424,516. However, the said conventional elliptical machine is not equipped with an electric extension length and crank rod length sensing structure, and is incapable of supporting program designs that automatically control exercise locus patterning. Since the said elliptical machine like the preceding iteration is evidently incapable of matching the different physical constitutions, strides, and jogging speeds of users with exercise patterns that automatically vary the maximum interval of the two pedal boards, it similarly not ergonomically compliant and incapable of optimal exercise efficacy.

In view of shortcomings of the said conventional connecting rod locus-type exercise apparatus, including no means of matching user physical constitutions or jogging speed at different strides as well as automatically sensing and controlling changes in exercise locus, that renders them incapable of genuinely satisfying user exercise physiological requirements and effectively attaining optimal exercise efficacy, the applicant conducted extensive research and development based on many years of structural design experience that culminated in the successful development of the practical and functional invention herein.

SUMMARY OF THE INVENTION

The primary objective of the invention herein is to provide a method and device capable of matching user physical constitution and jogging speed at different strides as well as the automatic sensing and controlling of changes in exercise locus configuration to effectively match the physical build and current physiological condition of the user, thereby genuinely satisfying user exercise physiological requirements and effectively attaining optimal exercise efficacy and other functions.

The invention herein establishes an exercise physiology database, an exercise resistance pattern database, and an exercise locus database, the content of which includes the sensed user heart beat, leg angle speed, and connecting rod length, and other relevant figures. A controller then calculates and processes all the database data and figures to accordingly control the length extension of the connecting rod relative to the current physiological condition of the user. As such, the present invention enables the exercise apparatus to have an operational means of locus configuration to effectively match the physiological condition of the user, thereby achieving utilization convenience, safety, and enhanced exercise efficacy.

DETAILED DESCRIPTION OF THE INVENTION

Figure 1:
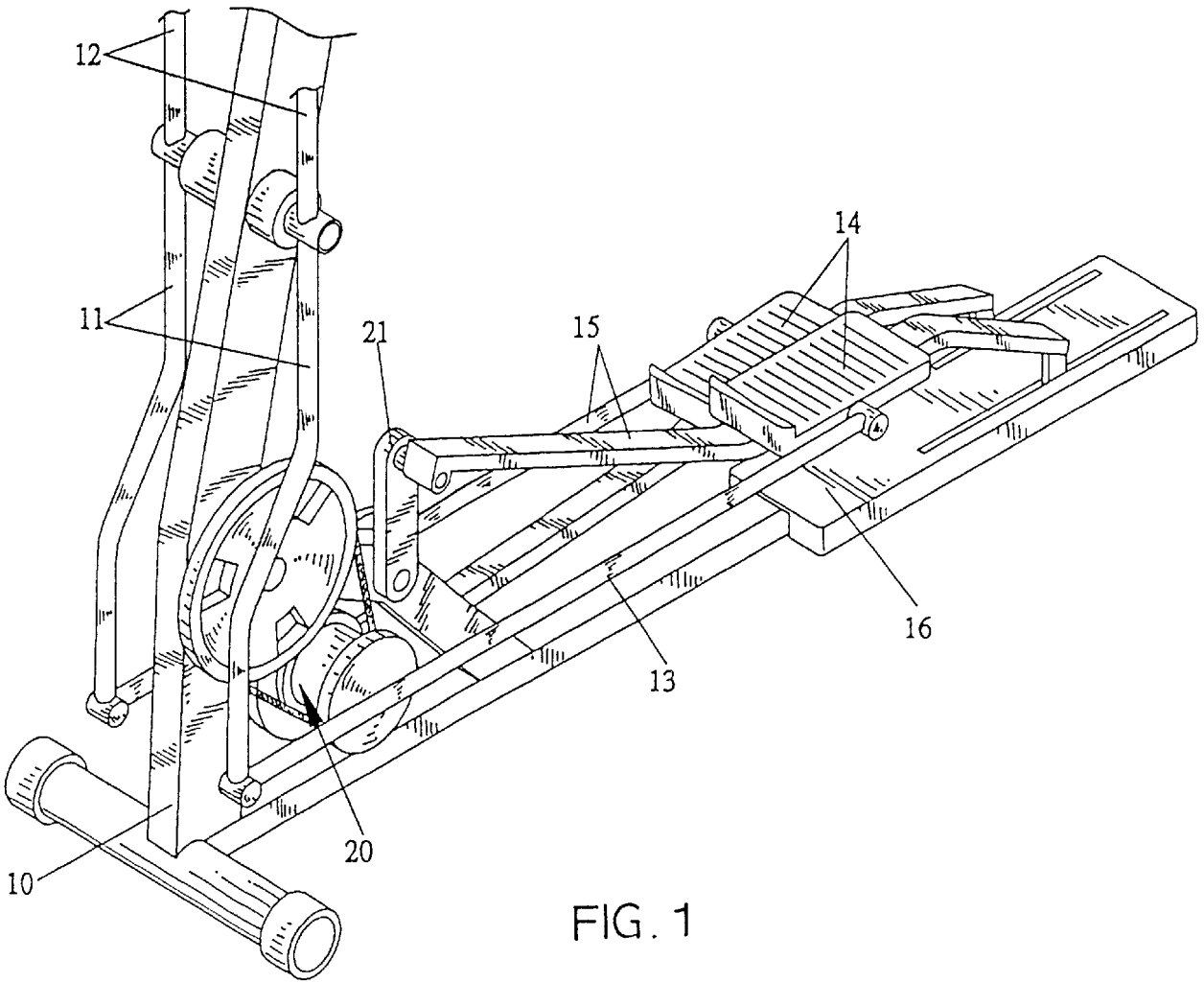
FIG. 1 is an isometric drawing of the prior art.
Figure 2:
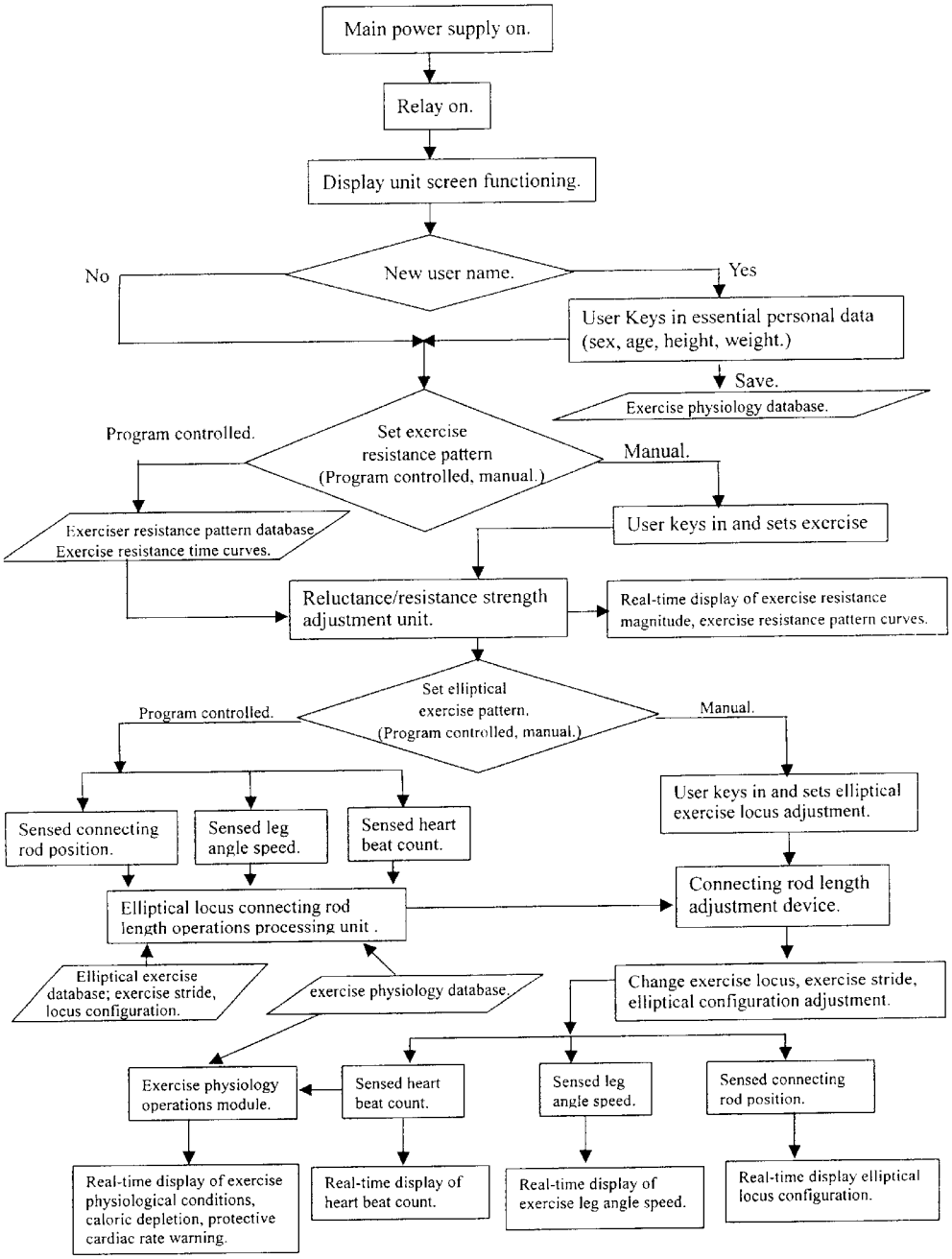
FIG. 2 is a flowchart of the control routine of the invention herein.
Figure 3:
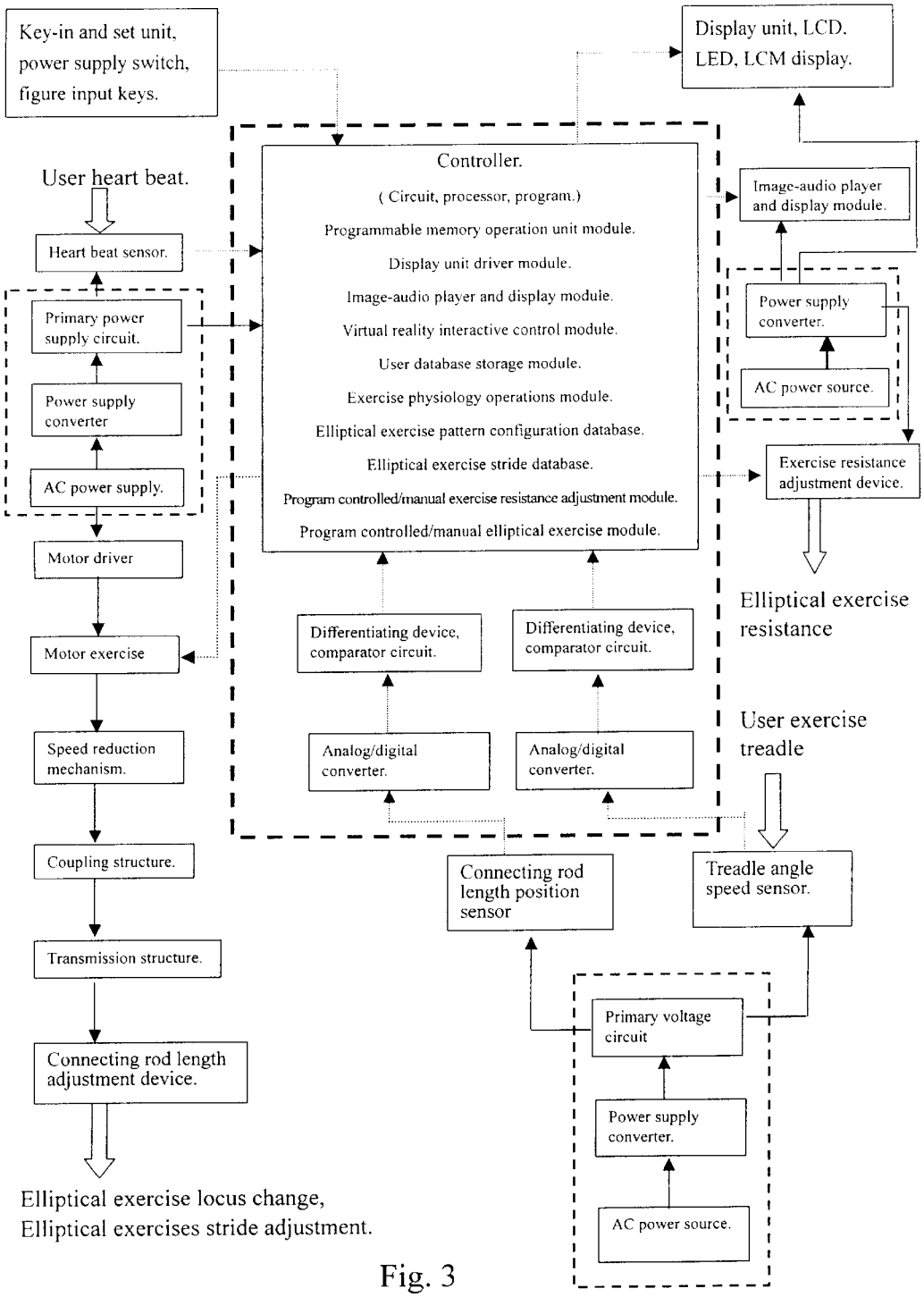
FIG. 3 is a block diagram of the system of the invention herein.

Referring to FIG. 2 and FIG. 3, the method of the invention herein consists of establishing an exercise physiology database, an exercise resistance pattern database, and an exercise locus database, and through the exercise resistance pattern settings and locus exercise pattern settings along with the sensed user heart beat, leg angle speed, and connecting rod length, and other relevant figures therein, a controller then calculates and processes all the database data and figures to accordingly control the length extension of the connecting rod relative to the current physiological condition of the user, enabling the exercise apparatus to have an operational means of locus configuration to effectively match the physiological condition of the user, thereby achieving utilization convenience, safety, and enhanced exercise efficacy.

Options inputted under user names are shown on the screen of a display unit to allow new users to input essential personal physiological data onto the screen of the said display unit and store it to establish the exercise physiological database of the said new user.

The exercise resistance pattern settings and locus exercise pattern settings can be selected manually or via programmed automatic control.

The system is comprised of:

A key-based inputting and entering unit having a power supply switch and figure input keys.

A controller that consists of a programmable memory operations unit module, a display unit driver module, an image-audio player and display module, a virtual reality interactive control module, a user database storage module, an exercise physiology operations module, an exercise locus pattern database, an exercise step distance database, a programmed/manual exercise resistance adjustment module, and a programmed/manual elliptical locus exercise module.

An exercise resistance adjustment device, the said exercise resistance adjustment device receiving commands directly from the controller to adjust exercise resistance.

A heart beat sensor, the said heart beat sensor connected to the said controller to facilitate signal transmission and, furthermore, furnished power controlled by a power supply and a primary voltage circuit control.

A connecting rod length position sensor, the said connecting rod length position sensor connected to the controller via an analog/digital converter and a differentiating comparator circuit to facilitate signal transmission and, furthermore, furnished power controlled by a power supply and a primary voltage circuit control.

A leg angle speed sensor, the said leg angle speed sensor connected to the controller via an analog/digital converter and a differentiating comparator circuit to facilitate signal transmission and, furthermore, furnished power controlled by a power supply and a basic voltage circuit control.

A connecting rod adjustment device that consists of a motor driver, a speed reduction mechanism, a coupling structure, and a transmission structure, the said motor driver connected to the controller to facilitate signal transmission, with the said transmission structure extending the length of the connecting rod.

When the system of the invention herein is implemented, an image-audio player and display unit is additionally connected to the image-audio player and display module at the controller, the said image-audio player and display unit having a power supply that enables it to convey graphics and sound.

When the system of the invention herein is implemented, the virtual reality interactive control module additionally installed at the controller enables the showing of virtual reality on the display.

Figure 4:
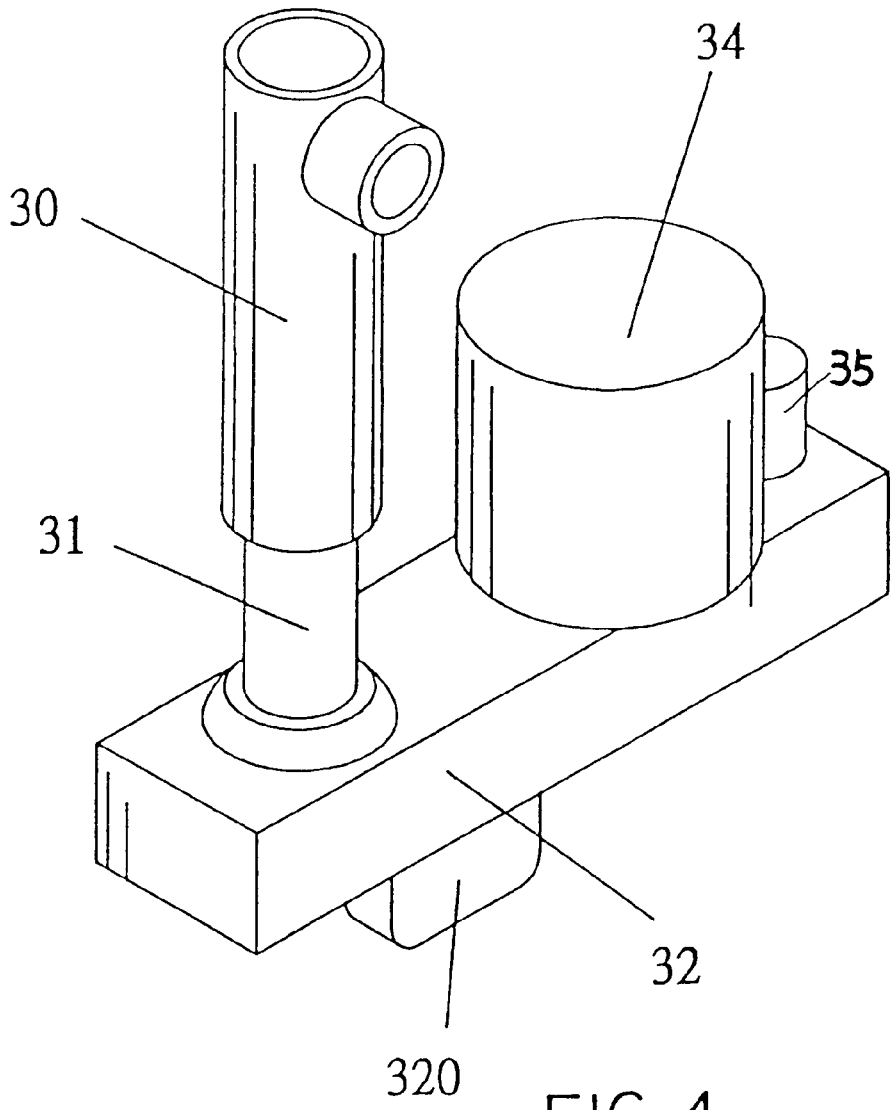
FIG. 4 is an isometric drawing of the connecting rod length adjustment device of the invention herein.
Figure 5:
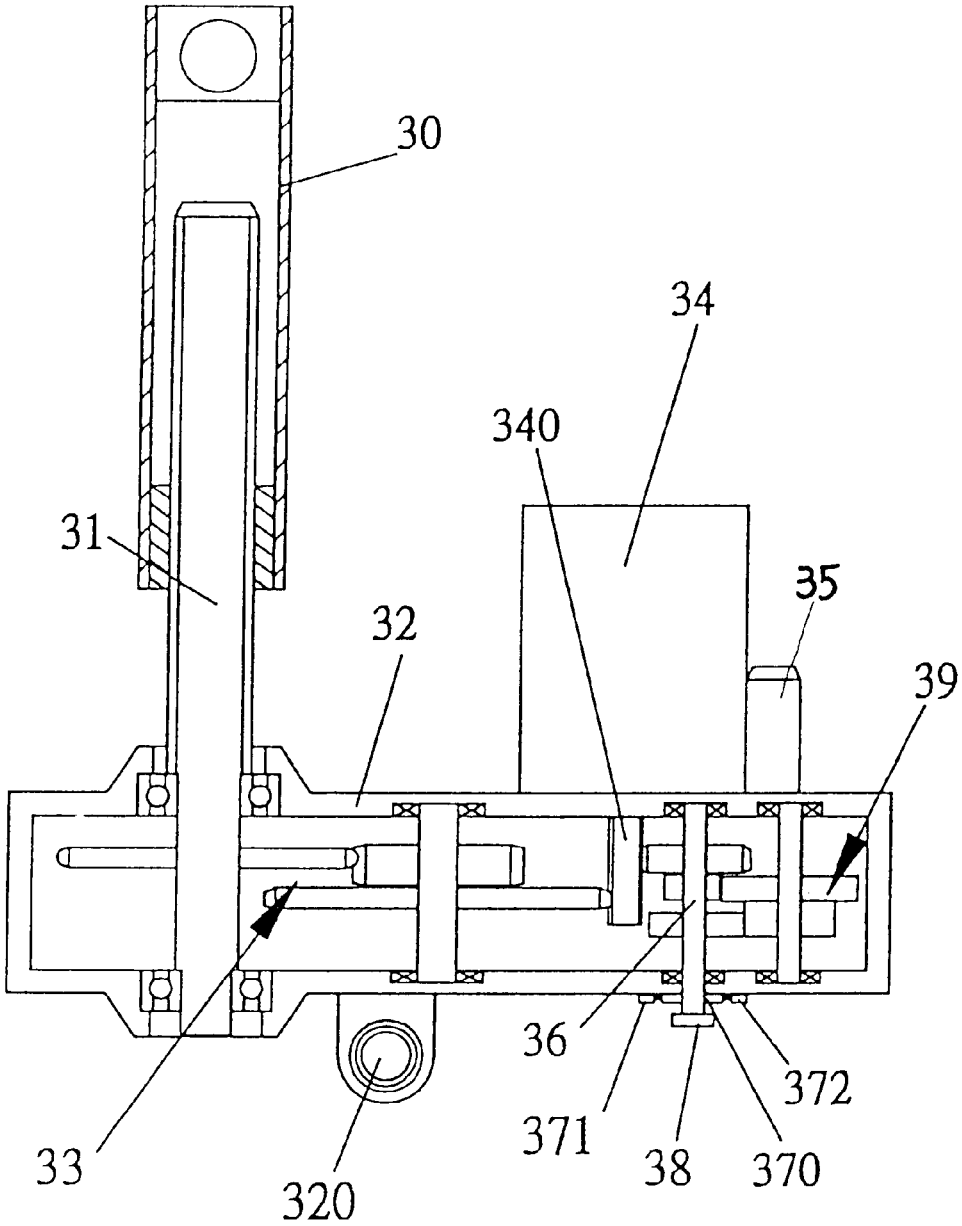
FIG. 5 is a cross-sectional drawing of the connecting rod length adjustment device of the invention herein.
Figure 6:
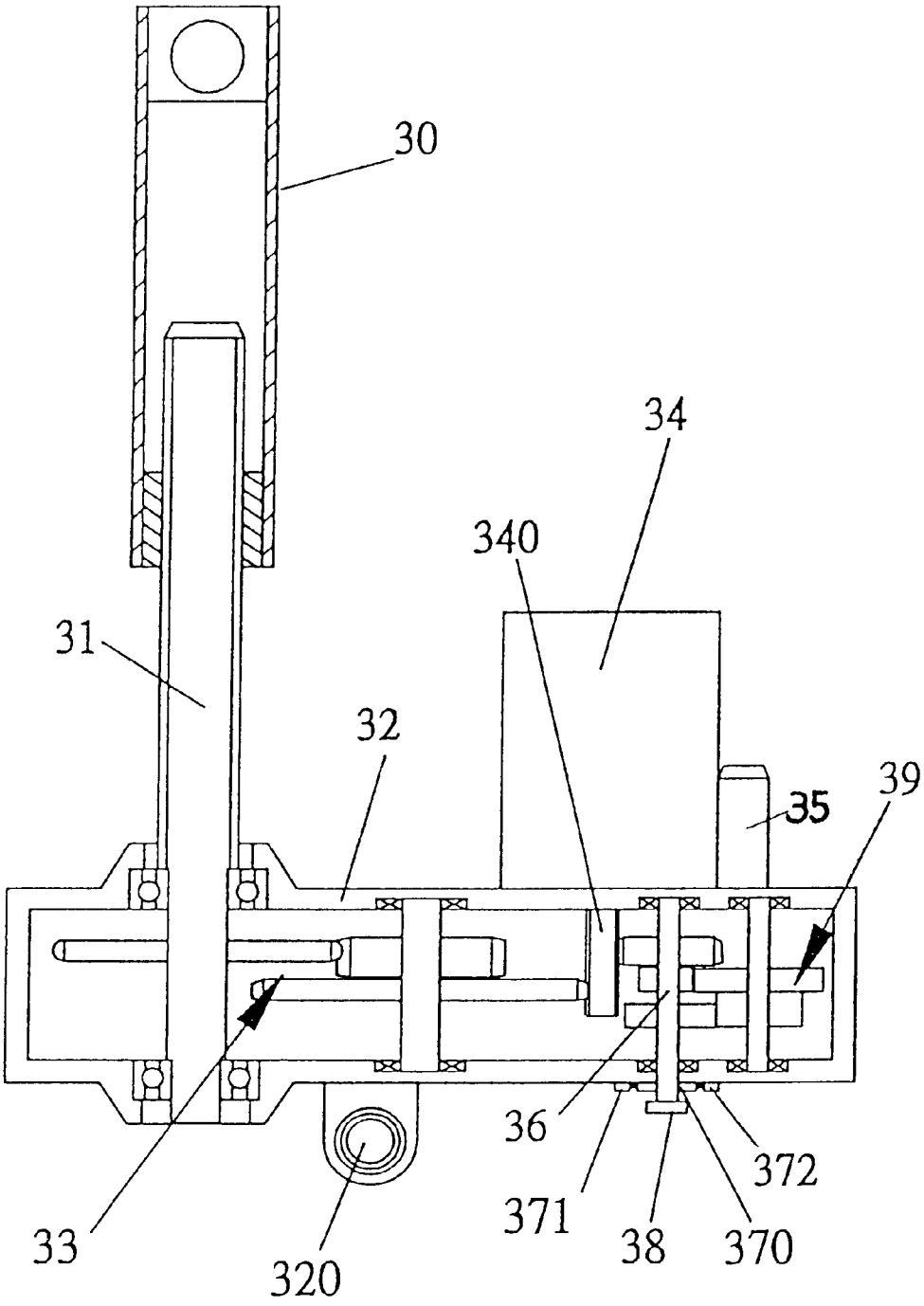
FIG. 6 is a cross-sectional drawing of the connecting rod length adjustment device of the invention herein after length variance.

Referring to FIG. 4, FIG. 5, and FIG. 6, the connecting rod adjustment device in the system of the invention herein is a connecting rod comprised of a primary connecting rod 30 and a secondary connecting rod 31 that are thread-fastened together, a box chassis 32 at the bottom end of the said secondary connecting rod 31, a motor 34 on the said box chassis 32, a shaft having teeth 340 in the said motor 34, a reduction gear train 33 though which the said teeth 340 are mechanically linked to the secondary connecting rod 31, a counter shaft 36 synchronously driven by another transmission gear train 39 at the said teeth 340 that collectively functions as a length of travel sensing and control device, a rotary-type variable resistor 38 and a gear 370 disposed on the said counter shaft 36, a maximum limit switch 371 and 372 situated at each of the two sides of the said gear 370, a capacitor 35 connected to the motor 34 and, furthermore, a revolving connector 320 positioned on the box chassis 32, with the said revolving connector 320 conducting motor power and sensor signals.

When the invention herein is utilized, options inputted under user names are shown on the screen of the display unit; in the case of a new user, essential personal physiological data is inputted onto the screen of the said display unit and stored to establish the exercise physiological database of the said new user; with the establishment of the exercise physiological database of the said new user or the old user completed, program control or manual control signals are directly selected and inputted at the key-based inputting and entering unit; if the exercise resistance pattern is set to program control, the associated exercise resistance and time curves previously stored in the exercise resistance pattern database are outputted as control signals to the exercise resistance strength adjustment unit; if the exercise resistance pattern is set to manual control, the user selects the associated exercise resistance and time curves that are outputted as control signals to the exercise resistance strength adjustment unit, and the exercise locus pattern is then set by the connecting rod length sensed, the leg angle speed sensed, and the heart beat count figure signals, wherein the said signals are inputted to the exercise locus connecting rod length operations processor unit for calculation and processing, the said operations processor unit at the same time retrieves the relevant data figures of the exercise physiology database and the locus exercise database along with the connecting rod length sensed figures, the leg angle speed sensed figures, and the heart beat count figures for processing and calculation, and then controls and adjusts the connecting rod length to the commensurate length, enabling the exercise locus of the connecting rod-type exercise apparatus to effectively match the physiological condition of the user.

As a result, the following advantages can be summarized about the said structural design:

1. The present invention matches the physiological condition of the user and affords control over the locus configuration of the connecting rod mechanism, enabling the exercise locus of the connecting rod-type exercise apparatus to match the physiological condition of the user and, therefore, effectively enhance the exercise efficacy of the connecting rod-type exercise apparatus.
2. As previously described, since the invention herein is capable of matching the physiological condition of the user by the automatic adjustment of the exercise locus such that the user is not required to stop to make adjustments during workouts, the present invention increases user convenience.

3. The automatically adjusted exercise locus of the invention herein that matches the physiological condition of the user also prevents the exercise locus from excessive physiological loading and thereby provides for exercise safety and, furthermore, if additionally equipped with caloric depletion and protective cardiac rate warning devices to indicate user over-exercising allows the user to discontinue exercising at the appropriate time to thereby ensure safe exercising.

What is claimed is:

1. An exercise pattern control system for connecting rod locus-type exercise apparatus comprised of:

a key-based inputting and entering unit having a power supply switch and figure input keys;

a controller that consists of a programmable memory operations unit module, a display unit driver module, an image-audio player and display module, a virtual reality interactive control module, a user database storage module, an exercise physiology operations module, an exercise locus pattern database, an exercise step distance database, a programmed/manual exercise resistance adjustment module, and a programmed/manual elliptical locus exercise module;

an exercise resistance adjustment device, the said exercise resistance adjustment device receiving commands directly from the said controller to adjust exercise resistance;

a heart beat sensor, the said heart beat sensor connected to the said controller to facilitate signal transmission and, furthermore, furnished power controlled by a power supply and a primary voltage circuit control;

a connecting rod length position sensor, the said connecting rod length position sensor connected to the said controller via an analog/digital converter and a differentiating comparator circuit to facilitate signal transmission and, furthermore, furnished power controlled by a power supply and a primary voltage circuit control;

a leg angle speed sensor, the said leg angle speed sensor connected to the said controller via an analog/digital converter and a differentiating comparator circuit to facilitate signal transmission and, furthermore, furnished power controlled by a power supply and a basic voltage circuit control;

a connecting rod adjustment device that consists of a motor driver, a speed reduction mechanism, a coupling structure, and a transmission structure, the said motor driver connected to the controller to facilitate signal transmission, with the said transmission structure extending the length of the connecting rod.

2. An exercise pattern control system for connecting rod locus-type exercise apparatus as claimed in claim 1 in which the said image-audio player and display module at the controller is additionally connected to an image-audio player and display unit, with the said image-audio player and display unit having a power supply.

3. An exercise pattern control system for connecting rod locus-type exercise apparatus as claimed in claim 1 in which the virtual reality interactive control module additionally installed at the controller enables the showing of virtual reality on the said display.

4. An exercise pattern control system for connecting rod locus-type exercise apparatus as claimed in claim 1 in which the said connecting rod adjustment device is a connecting rod comprised of a primary connecting rod and a secondary connecting rod that are thread-fastened together, a box chassis at the bottom end of the said secondary connecting rod, a motor on the said box chassis, a shaft having teeth in the said motor, a reduction gear train though which the said teeth are mechanically linked to the said secondary connecting rod, a counter shaft synchronously driven by another transmission gear train at the said teeth that collectively functions as a length of travel sensing and control device, a rotary-type variable resistor and a gear disposed on the said counter shaft, a maximum limit switch situated at each of the two sides of the said gear, a capacitor connected to the said motor and, furthermore, a revolving connector positioned on the said box chassis, with the said revolving connector conducting motor power and sensor signals.

* * * * *